US011905673B2

(12) United States Patent
Bartminn et al.

(10) Patent No.: US 11,905,673 B2
(45) Date of Patent: Feb. 20, 2024

(54) VIBRATING FOUNDATIONS

(71) Applicant: RWE Renewables GmbH, Essen (DE)

(72) Inventors: Daniel Bartminn, Elmshorn (DE); Volker Herwig, Hamburg (DE); Benjamin Matlock, Hamburg (DE)

(73) Assignee: RWE Renewables GmbH, Essen (DE)

( * ) Notice: Subject to any disclaimer, the term of this patent is extended or adjusted under 35 U.S.C. 154(b) by 204 days.

(21) Appl. No.: 17/432,558

(22) PCT Filed: Oct. 2, 2019

(86) PCT No.: PCT/EP2019/076734
§ 371 (c)(1),
(2) Date: Aug. 20, 2021

(87) PCT Pub. No.: WO2020/169218
PCT Pub. Date: Aug. 27, 2020

(65) Prior Publication Data

US 2022/0145566 A1 May 12, 2022

(30) Foreign Application Priority Data

Feb. 20, 2019 (DE) ..... 10 2019 104 292.5

(51) Int. Cl.
*E02D 7/26* (2006.01)
*E02D 29/09* (2006.01)

(52) U.S. Cl.
CPC ..... *E02D 7/26* (2013.01); *E02D 29/06* (2013.01)

(58) Field of Classification Search
CPC ..... E02D 7/26; E02D 29/06
See application file for complete search history.

(56) References Cited

U.S. PATENT DOCUMENTS

| | | | |
|---|---|---|---|
| 3,766,741 | A | 10/1973 | Hartzell |
| 2017/0362790 | A1 | 12/2017 | Chen et al. |

FOREIGN PATENT DOCUMENTS

| | | | | |
|---|---|---|---|---|
| CN | 107178084 | A | | 9/2017 |
| EP | 1992742 | A2 | | 11/2008 |
| EP | 3051028 | B1 | | 12/2017 |
| JP | S566814 | A | | 1/1981 |
| JP | H11140879 | A | | 5/1999 |
| JP | 2000110185 | A | | 4/2000 |
| JP | 2002115257 | A | | 4/2002 |
| JP | 2014201971 | A | | 10/2014 |
| JP | 201771994 | A | | 4/2017 |
| JP | 2017223006 | A | | 12/2017 |
| KR | 20070117237 | A | | 12/2007 |
| KR | 20090010974 | A | | 1/2009 |
| KR | 20190050078 | A | * | 5/2019 |
| WO | 2007115573 | A1 | | 10/2007 |

* cited by examiner

*Primary Examiner* — Kyle Armstrong
(74) *Attorney, Agent, or Firm* — The Webb Law Firm

(57) ABSTRACT

The subject matter relates to a method and an apparatus for vibrating-in a foundation into a building ground by initiating vibrations generated by means of a vibrating device attached to the foundation, the vibrations causing liquefaction of the building ground so that the foundation penetrates the building ground.

14 Claims, 2 Drawing Sheets

VIBRATING FOUNDATIONS

CROSS-REFERENCE TO RELATED APPLICATIONS

This application is the United States national phase of International Application No. PCT/EP2019/076734 filed Oct. 2, 2019, and claims priority to German Patent Application No. 10 2019 104 292.5 filed Feb. 20, 2019, the disclosures of which are hereby incorporated by reference in their entirety.

BACKGROUND OF THE INVENTION

Field of the Invention

The invention relates to an apparatus and a method for installing a foundation, e.g. a pile, for founding and/or anchoring of structures, in particular offshore structures.

Description of Related Art

For founding and/or anchoring of structures, e.g. vibrated piles are used. It is also known that piles installed by vibrating have a reduced axial and also lateral load-bearing capacity compared to driven piles. For this reason, piles are usually driven by impacts for the last few metres (e.g. over a distance of approximately eight times the corresponding pile diameter).

When installing piles of a foundation for onshore or offshore structures into a building ground by means of vibratory pile drivers, the vibration process of installing a pile, scheduled or unscheduled, can be interrupted by deactivating the vibration device. To continue the vibration process, the vibration device must be reactivated. During the interruption, a weight acting on the pile is increased, for example, or any necessary adjustment work or repairs are carried out.

However, due to the partial restraint of the pile by the building ground and the consolidation of a soil layer close to the pile casing, which liquefies during vibration, the vibration behaviour can change so that further sinking into the building ground by means of vibratory driving is difficult or no longer possible.

Furthermore, there may be applications where it is not (or no longer) possible to drive-vibrated piles in the last few metres because, for example, the soil deviates significantly from the expected soil densities, or the corresponding impact hammer is not available due to a technical failure.

From U.S. Pat. No. 3,766,741, method and apparatus for driving a tubular pile into the ground characterized by filling and retaining a column of liquid in a substantially static condition in the pile are known, said column extending from substantially the bottom of the pile to a point located a predetermined distance below the top of the pile, while applying driving forces directly to the top of the pile.

EP 3 051 028 A1 describes a method for vibratory driving of profiles into a building ground to a given final depth, comprising the axial introduction of high-frequency vibrations into the profile and into the building ground in front of a profile foot by means of a vibrator with partial liquefaction of the building ground in front of the profile foot, wherein the vibration frequency of the vibrator is varied during the vibration process within a given liquefaction frequency band of the building ground.

JP 2014 201971 A describes a construction method that performs driving or extraction a pile by using a vibrational pile driving/extracting machine having an exciter. The exciter has a phase regulator for regulating a relative phase of a fixed-movable eccentric weight, wherein the depth of an object foundation and the relationship of a change of a N value are measured before the driving-in of the pile. Before driving-in of the pile, a regulation pattern of the phase is preset by the phase regulator so that it can change according to the change of the N value measured by the eccentric moment through a weight.

A disadvantage is that there is a building ground risk when piles are vibrated in, as it may happen that if the vibration process is interrupted, a continuation is not possible anymore. One reason for this is, for example, besides the mere interruption and reconsolidation of the liquefied layer, also setup effects such as pore water overpressure degradation, to name but one non-limiting example.

It would be desirable to be able to control and/or regulate the vibrational driving-in.

SUMMARY OF THE INVENTION

The object of the invention is to reduce or avoid the known disadvantages vibrating-in of foundations, e.g. piles, in particular for offshore structures, and in particular to improve the vibrating-in of such piles by making it possible to control and/or regulate the vibrating-in.

According to a first exemplary aspect of the invention, a method is disclosed for vibrating-in a foundation into a building ground by initiating vibrations generated by means of a vibrating device attached to the foundation, the vibrations causing liquefaction of the building ground so that the foundation penetrates the building ground, wherein the rate of penetration of the foundation into the building ground is controlled and/or regulated by varying the liquefaction zone of the building ground directly surrounding the foundation, wherein the rate of penetration is varied by varying the size of the liquefaction zone.

According to a second exemplary aspect of the invention, there is disclosed an apparatus configured to perform and/or control the method according to the first aspect of the invention, or comprising respective means for performing and/or controlling the steps of the method according to the first aspect of the invention. In this regard, either all steps of the method may be controlled, or all steps of the method may be executed, or one or more steps may be controlled and one or more steps may be executed. One or more of the means may also be executed and/or controlled by the same unit.

These two aspects of the present invention have, inter alia, the—partly exemplary—characteristics described below.

It has been recognized that, for example, in the case of pile installation, in particular for the foundation of offshore structures, a liquefaction of the building ground surrounding the pile occurs by means of vibration, also referred to as vibrating-in, e.g. in sandy soils. Such liquefaction allows the pile to sink or penetrate into the ground under its own weight. An increase in the liquefaction zone surrounding the pile thus leads to improved pile insertion into the building ground during vibration. Accordingly, control and/or controllability of a foundation insertion (e.g. a pile installation encompassed by a foundation) can also be achieved via control of these processes. The penetration speed can further be increased by increasing a foundation load (e.g. pile load), e.g. by applying an (external) mass to the foundation (e.g. a pile). The penetration velocity is further altered, for example, by changing the coefficient of friction of the liquefaction zone and/or by changing the hydrostatic gradient between the outside and inside of the foundation (e.g. between the inside and outside of the pile).

Changing the coefficient of friction of the liquefaction zone can be done, for example, by means of injecting air and/or gases, and furthermore the degree of liquefaction can be changed by increasing respectively decreasing the injection of air and/or gases. The change in the hydrostatic gradient between the outside and inside of the foundation can, for example, be effected by means for pumping liquid out of or into the interior of the foundation. Further details in this regard are disclosed below in this specification.

For example, the foundation comprises or consists of one or more pipe segments. The one or more pipe segments form, for example, a pile (also referred to as a foundation pile or monopile). The foundation is, for example, open downwards. For example, the end of the foundation penetrating the building ground is open downwards, e.g. in the direction of penetration into the building ground. The foundation is, for example, a pile.

The foundation can, for example, be in the form of sheet pile walls, sheet pile profiles, in the form of piles, in particular foundation piles for monopiles, for example, or in the form of profiles of any design.

Since, especially in the installation of offshore foundations, for example, the driving-in of piles for the foundations of so-called monopiles, jackets or other foundation types is not undisputed, e.g. due to the associated noise development, which can lead, for example, to an impairment of marine mammals, it is envisaged that the installation process of vibrating-in of the foundation is improved by changing the liquefaction zone, and thus this lower-noise installation variant becomes more attractive.

The end of the foundation penetrating into the building ground (e.g. pile end) is, for example, designed in such a way that material transport (e.g. through the penetration of displaced foundation soil) into the interior of the foundation (e.g. into the hollow pile) is supported. Alternatively, the end of the foundation that penetrates the building ground is designed, for example, in such a way that the transport of material into the interior of the foundation is reduced or prevented.

The vibrating device is also referred to as a vibrator or a vibrating bear.

Vibrations in the sense of the present object are to be understood as vibrations which are capable of propagating into the building ground in such a way that, for example, both the skin friction and the peak resistance of the building ground are overcome in the case of the foundation is brought into the building ground, the soil in front of a profile foot of the foundation (e.g. pile) is quasi liquefied, whereby the foundation penetrates the building ground as a result of its weight force.

For example, an oscillation within the meaning of the present subject matter is to be understood as an oscillation within a frequency band from about 5 Hz to 150 Hz, preferably from 10 Hz to 50 Hz.

The penetration process of the foundation into the building ground is understood to be the process—also referred to as the penetration process—in which the foundation is inserted into the building ground to its intended final depth.

In all aspects, an effective mass of the foundation is increased or decreased during penetration into the ground by pumping fluid from or into the interior of the foundation.

For example, the foundation comprises means for extracting water to enable pumping of liquid. The pumping of liquid from the interior of the foundation is done, for example, in such a way that there is a possibility of extracting water from, for example, water entering the interior of the foundation during its penetration into the building ground. This is, for example, seawater and/or groundwater originating from the building ground. The means for extracting water comprise, for example, a pipe and/or hose which is inserted or can be inserted and removed from the foundation so that, for example, liquid, fluid and/or water can be conveyed (e.g. pumped) from the inside of the foundation to the outside. As a result, for example, a water level inside the foundation is reduced.

The effective mass of the foundation within the meaning of the present object is to be understood as the proportion of the weight force from the foundation which is applied onto the building ground via the end of the foundation into the building ground and overcomes the skin friction of the foundation.

By varying the effective mass of the foundation, for example, the vibration behaviour of the foundation can also be changed. Furthermore, by varying the mass and thus the weight of the foundation acting on the ground, its penetration speed into the ground can be varied and adapted to given or required requirements.

Pumping liquid from inside the foundation can, for example, change a hydrostatic pressure that exists inside the foundation.

Hydrostatic pressure, also referred to as gravitational pressure or gravity pressure, is the pressure that prevails inside a fluid at rest, such as a liquid gas, inside the foundation due to the influence of gravity. A change in the hydrostatic pressure inside the foundation can result in a change in the mass acting during the penetration of the foundation into the ground.

A pumping of liquid disclosed above can thus be used to vary the rate of penetration of the foundation into the building ground.

Since the penetration speed of the foundation into the building ground can also be varied by varying the effective mass of the foundation, a lateral load capacity of the foundation placed in the building ground can also be increased as a result, since, for example, the liquefaction zone is reduced on the last metres until the final depth is reached, so that only a (very) slow penetration of the foundation into the ground is possible.

In the event that there are one or more holes in the foundation, these can be at least temporarily closed to allow pumping or draining of liquid, e.g. with appropriate means. Such holes in the foundation may be, for example, cable entry holes and/or other secondary openings, to name but a few non-limiting examples. Such holes may be temporarily closed, for example, with rubber plugs. By means of a suitable removal means, e.g. a wire or the like, the rubber plugs can be removed, for example, after the foundation has been installed.

An exemplary embodiment according to all aspects of the present invention provides that the liquefaction zone is modified by means of an injection of air and/or gases at the foundation.

The injection of air and/or gases is done, for example, by means for injecting air and/or gases at the foundation. The means for injecting air and/or gases are, for example, injection lances and/or hoses. The injection of air and/or gases causes, for example, a loosening of the ground near the foundation (e.g. near the pile). As a result of the injection of air and/or gases by the air and/or gas injection means, a better transmission of vibrations (e.g. pile vibrations) during the vibrating-in of the foundation into the building ground (e.g. soil) is achieved, which contributes to a greater liquefaction. This also leads to a change (e.g. increase or decrease) in the degree of liquefaction via an increased or decreased injection of air and/or gases, as the coefficient of friction that has to be overcome to insert the foundation into the building ground and that exists between the outer wall of the foundation and the surrounding building ground is changed. The coefficient of friction is increased, for example, by reducing the amount of injected air and/or gases, or the coefficient of friction is reduced by increasing the amount of injected air and/or gases.

Such means for injecting air and/or gases can, for example, inject air and/or gas inside the foundation (e.g. a pile). Such means for injecting air and/or gases are for example formed as one or more (air) lances and/or hoses. One or more of such lances and/or hoses may, for example, be connected (e.g. by gluing or welding or similar means, to name but a few non-limiting examples) or be attached to the foundation (e.g. pile) itself or via a support frame, or directly to the pile wall, to name but a few non-limiting examples.

An exemplary embodiment according to all aspects of the present invention provides that the air and/or gas is applied above the end of the foundation penetrating the building ground.

The injection of air and/or gas, for example generated by the means for injecting air and/or gases, results for example in air and/or gas bubbles which are found in particular about 0.1 m, 0.2 m, 0.3 m, 0.4 m, 0.5 m, or more above the lower edge of the foundation (e.g. above the lower edge of the pile) into the building ground (e.g. seabed). Accordingly, for example, by means of the lances and/or hoses, the air and/or gas is applied into the building ground (e.g. seabed) approximately 0.5 m above the lower edge of the foundation (e.g. above the lower edge of the pile). The air and/or gas pressure for generating air and/or gas bubbles is generated e.g. by a compressor. For example, such a compressor may be comprised by an installation vessel. In this way, it is possible to deconsolidate the foundation structure (e.g. soil structure) inside the foundation (e.g. inside the pile) as a result of rising air and/or gas bubbles in such a way that simplified installation of the foundation or penetration of the foundation (e.g. pile) into the building ground is possible.

An exemplary embodiment according to all aspects of the present invention provides that the air and/or gas is further applied inside of the foundation.

The injection of air and/or gas, or the means for injecting air and/or gases, generate air and/or gas bubbles, for example, which in particular are about 0.5 m above the lower edge of the foundation and inside the foundation, e.g. inside the pile in the case that the foundation is a pile.

An exemplary embodiment according to all aspects of the present invention provides that the size of the liquefaction zone is changed by means of an injection of air and/or gas with increased or decreased air and/or gas pressure at the foundation.

Depending on the (absolute) depth at which the air and/or gas is applied, an increased air and/or gas pressure must be used, for example, in order to be able to bring about the size of the liquefaction zone by means of an injection of air and/or gases. The enlargement of the liquefaction zone is brought about either indirectly or directly by blowing in air and/or (other) gases.

If, for example, at a water depth of 30 mLAT (magnetic latitude), a pile surrounded by the foundation is driven 35 m into the building ground (e.g. seabed), there is, for example, a water pressure corresponding to 65 m (corresponding to 30 m water depth plus 35 m soil depth) depth of approximately 6.5 bar, or soil pressure at a depth of 35 m, from which the following formula can also be used to infer a prevailing pressure: Soil depth 35 m*20 kN/m3 approximately 700 kN/m2=7 bar. Accordingly, in this example the minimum air and/or gas pressure, which is applied by the means for blowing in air and/or gases and which is applied via e.g. the lances and/or hoses disclosed above, and which should be present, is to be set at significantly more than 7 bar. The means for injecting air and/or gases therefore generate, for example, a (maximum) air and/or gas pressure to be applied of up to 30 bar.

An exemplary embodiment according to all aspects of the present invention provides that the air and/or gas is injected inside the foundation, and/or on the outer wall of the foundation.

An applying or injecting of air and/or gases inside the foundation (e.g. a pile surrounded by the foundation) causes, for example, a softening of the soil structure, which is inside the foundation due to the penetration of the foundation into the building ground, as a result of rising air and/or gas bubbles. This leads to an easier insertion of the foundation into the building ground. Alternatively or additionally, air and/or gases can be applied or injected to the outer wall of the foundation (e.g. a pile surrounded by the foundation), which also has the effect that, for example, the soil structure, which is present on the outer wall of the foundation due to the penetration of the foundation into the building ground, is deconsolidated as a result of rising air and/or gas bubbles.

An exemplary embodiment according to all aspects of the present invention provides that the penetration of the foundation into the building ground is not interrupted during installation.

In contrast to the prior art of varying the mass (external to the foundation) to change the penetration speed, whereby it is necessary to interrupt the penetration process, it is intended that the penetration process is not interrupted. So once the foundation has started to be vibrated-in into the ground, the process is only stopped when the foundation has reached the intended final position.

In order not to interrupt the penetration of the foundation into the building ground, the variation of the effective mass of the foundation can be done—as already disclosed above. In particular, it should be avoided having to deactivate and reactivate the vibration device. The subject-matter makes it possible to vary the effective mass of the foundation without having to interrupt the penetration of the foundation into the building ground.

An exemplary embodiment according to all aspects of the present invention provides penetration progress detecting means, detecting whether the vibrating-in is slowed down, so that in this case an effective mass of the foundation is increased and/or the liquefaction zone is enlarged.

In order to detect whether the vibrating-in of the foundation into the building ground is slowed down in its speed, means can be provided for detecting one or more insertion parameters. For example, parameters such as frequency at the foundation, frequency of the vibrator, power, temperature, water level inside the foundation, water level at the outer wall of the foundation, flow rate of liquid (and/or fluid, and/or water) inside the means for extracting water, to name but a few non-limiting examples, may be detected. Accordingly, means for respective detection may be provided accordingly, and the detected information thereof may further be evaluated for controlling and/or regulating the penetration speed of the foundation.

Furthermore, means for detecting the insertion parameters can be designed to detect a pressure and/or a prevailing friction between the outer wall of the foundation and the building ground. These can be, for example, CPTs (Cone Penetration Test), which are connected to the foundation to be installed, e.g. with defined stiffness. CPTs enable pressure probing in a building ground. It is understood that other pressure measurement and/or force measurement methods, such as piezometric or strain-dependent measurement methods, are also possible and are suitable as objective means for gathering the insertion parameters according to the ones as disclosed above.

For example, the penetration speed of the foundation into the building ground is varied by changing the size of the liquefaction zone, whereby this takes place during the vibrating-in of the foundation. The penetration of the foundation into the building ground is only interrupted or stopped when the specified final depth is reached. Afterwards, the foundation can optionally be driven-in for the last metres to the final depth, e.g. in order to achieve soil consolidation or soil compaction, if this is possible or necessary. This can increase the lateral load-bearing capacity of the foundation. Alternatively, the foundation can be vibrated in at a (very) slow speed for the last few metres, or cavitatively vibrated again.

In principle, the penetration speed of the foundation can be adjusted via the frequency of the vibration device as well as via the effective weight force of the foundation. In addition to varying the liquefaction zone and/or pumping out liquid, this can also be taken into account to control and/or regulate the rate of penetration of the foundation.

An exemplary embodiment according to all aspects of the present invention provides that the rate of penetration of the foundation into the building ground is varied via means for varying the rate of penetration releasably connected to the foundation, in particular a pump and/or a compressor generating air and/or gas pressure.

According to another exemplary embodiment according to all aspects of the present invention, the means for varying the rate of penetration is comprised by a carrier device (e.g., a support frame).

The means for varying the rate of penetration (e.g., the one or more lances and/or hoses) may, for example, be permanently installed, at least temporarily. After the foundation is fully installed, the one or more lances and/or hoses can be removed, e.g., by removing a support frame comprising the one or more lances and/or hoses.

Varying applied air and/or applied gas by increasing or decreasing the air and/or gas pressure can be realized, for example, as follows: First, during the installation of the foundation—e.g., vibrating-in of the foundation into the building ground—an air and/or gas pressure is applied that is, for example, at least greater than the water pressure, and is thus primarily intended to prevent the one or more lances and/or hoses from becoming clogged, for example, with particles. Insofar as the installation progress of the foundation is slowed down, e.g. the penetration speed of the foundation into the building ground slows down, an increased air and/or gas supply takes place, for example, so that at best a turbulence is generated inside the foundation, so that the liquefaction zone will be or is enlarged.

If the lances and/or hoses are installed on a supporting frame, the frame can be firmly connected to the foundation (e.g. the pile), e.g. at the flange or by means of fastening lugs. As a result of the installation process during vibration, the frame with the pile is continuously inserted into the ground. In this case, the risk of clogging must be counteracted with a continuous supply of air and/or gas, for example, by continuously applying air and/or gas pressure to the lances and/or hoses. Again, if the installation progress is slowed down, the air and/or gas pressure must be steadily increased to counteract this accordingly. An upper limit for the amount of air and/or gases to be introduced is only limited by the compressor capacity.

When the foundation (e.g. pile) reaches its planned final depth, the support frame can be detached from the foundation (e.g. pile) while maintaining the air and/or gas pressure and, if necessary, can be pulled together with vibrators attached to the support frame. The air and/or gas pressure should not be switched off until the entire support frame is outside the building ground (e.g. soil). In this way, the tractive force required to remove the support frame can be minimized.

If the foundation (e.g. the pile) is installed in a driven manner and shows insufficient installation progress, this method requires the hammer used for driving in to be removed and, under pressure or by means of small vibrators, the support frame with the air and/or gas pressure lances to be driven into the ground to about 0.5 m above the end of the pile. Here, too, the air and/or gas pressure must then be greatly increased to loosen the soil in the pile. Finally, the support frame can be loosened and pulled as described above.

The application of air and/or gas pressure to the lances and/or hoses to loosen the soil can, for example, be achieved in the latter case over a period of at least 30 minutes. In the case of vibrated piles, for example, the air and/or gas pressure can be successively increased with reduced pile installation power.

An exemplary embodiment according to all aspects of the present invention provides that the air and/or gas is applied at an air and/or gas pressure greater than the water and/or soil pressure prevailing at the end of the foundation penetrating the foundation.

The object according to the invention is further solved by apparatus for vibrating-in a foundation into a building ground, which is adapted to execute and/or control a method according to all aspects of the present invention as disclosed above.

Such an apparatus for vibrating-in a foundation into a building ground comprises, for example, a vibrating device for generating vibrations; and means for varying a liquefaction zone which directly surrounds the building ground of the foundation and by which the rate of penetration of the foundation into the building ground is controllable and/or regulatable.

In another exemplary embodiment according to all aspects of the present invention, the apparatus further comprises means for pumping fluid from and/or into the interior of the foundation (e.g., one or more fluid/liquid pumps); means for injecting air and/or (other) gases (e.g., one or more compressors) at the foundation (e.g. e.g., inside the foundation, such as a pile, and/or at the outer wall of the foundation, such as the pile); means for detecting pressures at the outer wall and/or inside of the foundation and/or at the end of the foundation penetrating the ground; and/or means for detecting a friction between the outer wall of the foundation and the ground.

In another exemplary embodiment according to all aspects of the present invention, the apparatus is configured for one or more piles comprised by the foundation. For example, the apparatus according to the subject-matter is for an offshore structure (such as a wind turbine, an oil rig, a production platform, a substation and/or research platform, a pipeline, or a combination thereof, to name but a few non-limiting examples). For example, the apparatus according to the subject-matter is for a foundation to be placed in the seabed as a building ground.

The present method does not distinguish between an offshore and onshore foundation.

Further advantageous exemplary embodiments can be found in the following detailed description of some exemplary embodiments, in particular in connection with the figures. However, the figures are intended only for the purpose of clarification and not for determining the scope of protection. The figures are not to scale and are merely intended to reflect the general concept by way of example. In particular, features included in the figures are by no means to be considered as a necessary part.

BRIEF DESCRIPTION OF THE DRAWINGS

In the drawing shows

DESCRIPTION OF THE INVENTION

The present subject matter is described below with reference to exemplary embodiments.

Figure 1:
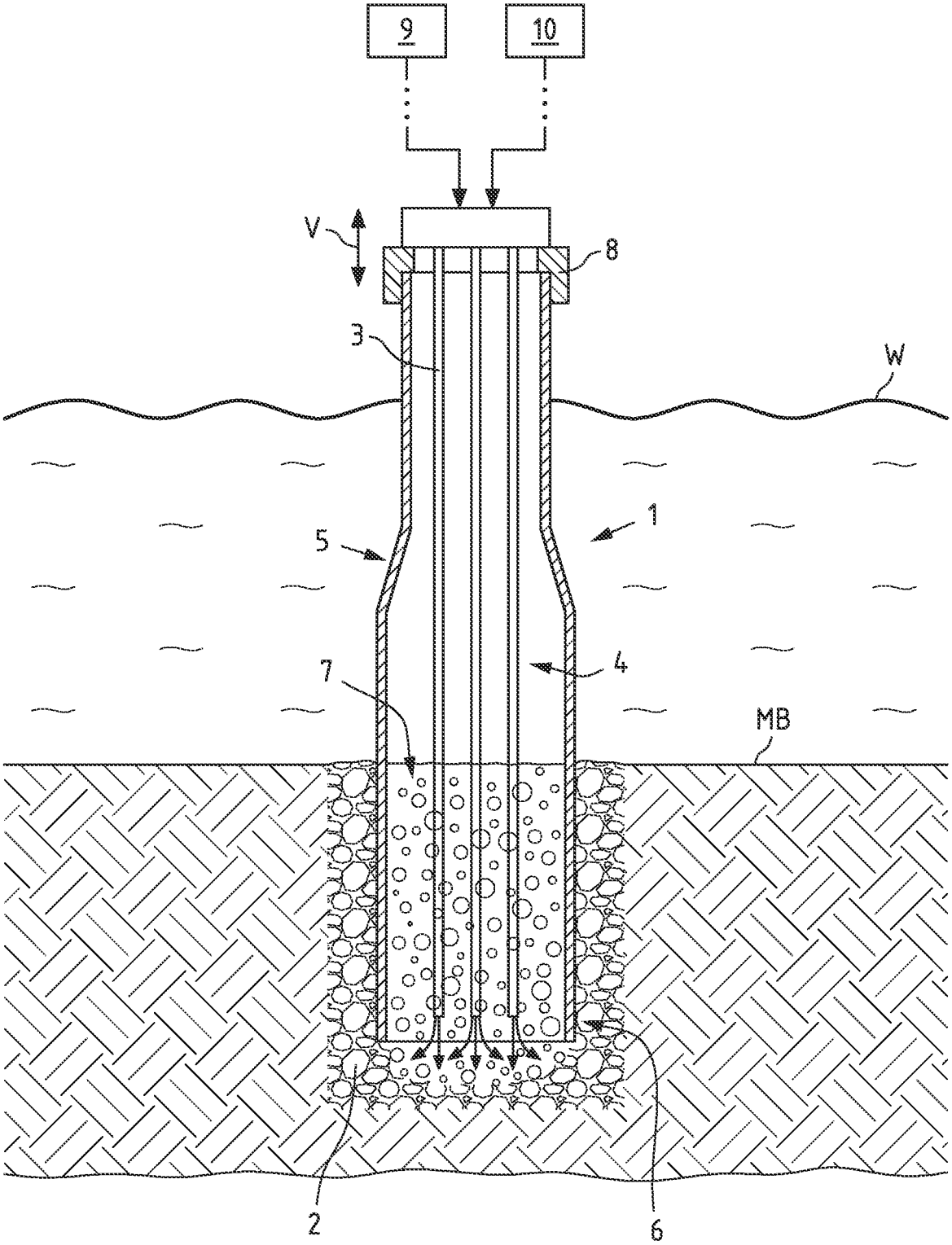
FIG. 1 an illustration of an exemplary embodiment of a foundation according to the subject-matter that is vibrated into a building ground by means of a method according to the subject-matter.

FIG. 1 shows an illustration of an exemplary embodiment of a foundation according to the subject-matter that is vibrated into a building ground by means of a method according to the subject-matter.

The foundation is represented in FIG. 1 by a pile 1 which is comprised by the foundation or which is the foundation. The pile is inserted into a building ground, in this case the seabed MB. Accordingly, the foundation in FIG. 1 is for an offshore structure, such as a wind turbine.

The liquefaction zone 2 is shown surrounding the end 6 of the pile 1 penetrating the seabed MB. By initiating vibrations, which are generated e.g. by means of a vibration device attached to the foundation (not shown in FIG. 1), a liquefaction of the seabed MB occurs immediately around the end 6 of the pile 1 penetrating the seabed MB. This is referred to herein as the liquefaction zone 2, and is shown hatched and outlined with a dashed line.

Within the liquefaction zone 2, the seabed MB is loosened by softening the structure caused by the generated vibrations transmitted to the seabed MB via the pile 1. The loosening of the seabed MB within the liquefaction zone 2 can be enhanced, for example, by injecting air and/or gases. This enlarges the liquefaction zone 2 so that the pile 1 can penetrate the seabed MB more easily. Furthermore, the rate of penetration of the pile 1 into the seabed MB can be controlled and/or regulated by varying the liquefaction zone 2.

The size of the liquefaction zone 2 is made possible by blowing in air, whereby the liquefaction zone 2 or its size is varied by increasing or decreasing the air pressure. Air is injected, for example, by means of a compressor 9, which is connected, for example, via a hose to one or more air lances 3. The compressor is located, for example, on an installation vessel, which is not shown in FIG. 1. The air lances extend into the pile 1, and are arranged on a support frame 8 that is detachably arranged on the pile 1 at least during the vibrating-in of the pile 1 into the seabed MB. After vibrating-in the pile 1 into the seabed MB, the support frame 8 can be removed, for example. The one or more air lances 3 extend up to the pile tip 6 penetrating the seabed MB, or up to about 0.5 m above the pile bottom edge 6.

The generated air is applied via the one or more air lances 3 above the penetrating end 6 of the pile 1, so that in particular the soil structure inside the pile 4 is deconsolidated as a result of rising air bubbles 7. As a result, a simplified installation of the pile 1 is possible.

Furthermore, a pump 10 is provided by means of which in particular fluid can be pumped out of the pile interior 4. For this purpose, the support frame 8 comprises, for example, one or more pipes and/or hoses which extend into the pile interior 4 analogously to the one or more air lances 3, so that liquid and/or fluid can be pumped out of the pile interior 4.

Figure 2:
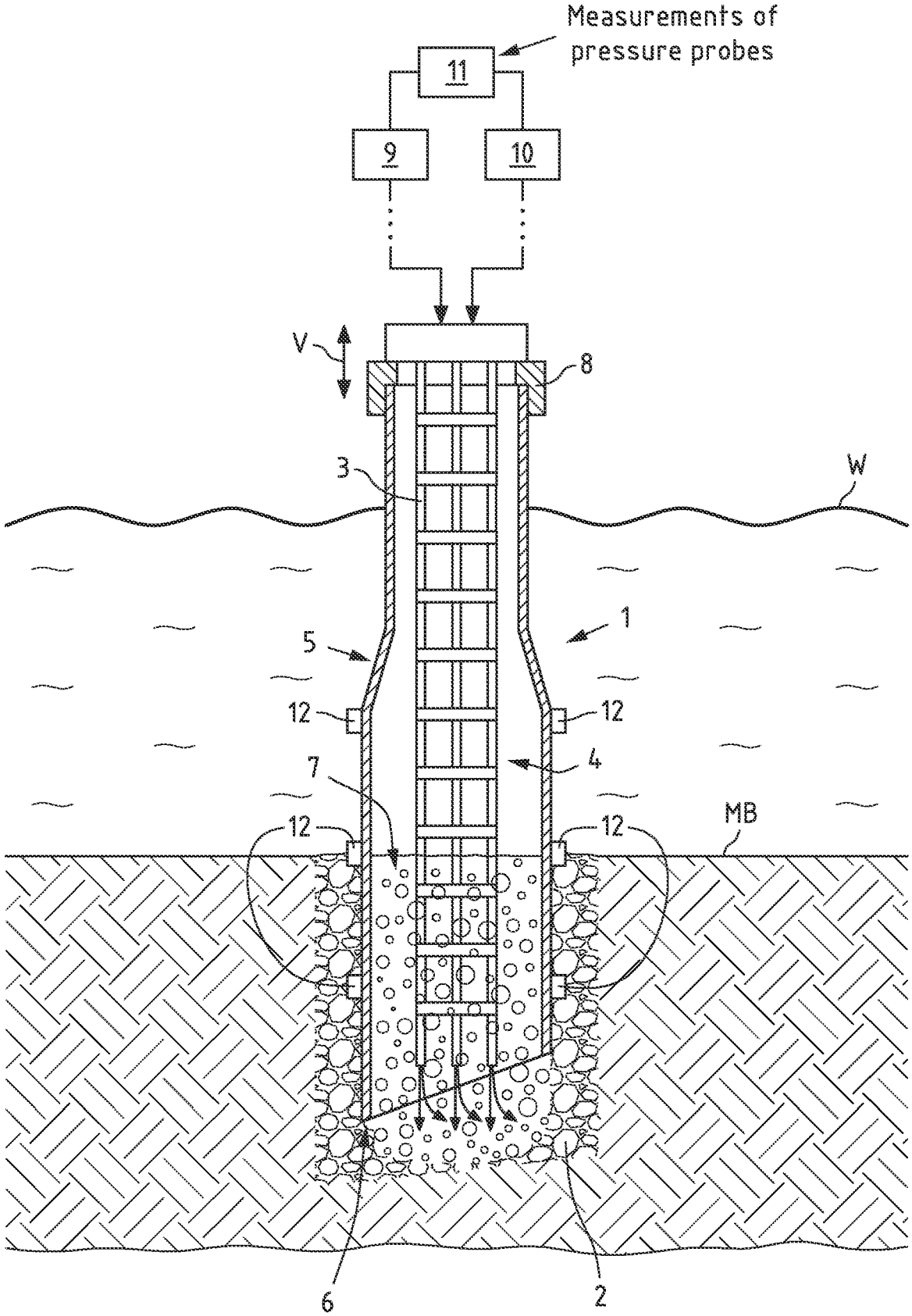
FIG. 2 an illustration of a further exemplary embodiment of a foundation according to the subject-matter, which is vibrated into a building ground by means of a method according to the subject-matter.

FIG. 2 shows another illustration of a further exemplary embodiment of a foundation according to the subject-matter that is vibrated into a building ground by means of a method according to the subject-matter.

In contrast to FIG. 1, the support frame 8, which comprises, for example, the one or more air lances 3, is arranged concentrically inside the pile 1. The support frame 8 is designed to be movable, in particular vertically movable, so that it can be moved into and out of the pile interior 4.

The pile tip 6, which penetrates the seabed MB, is further configured to support the material transfer of soil (e.g., the seabed MB) during the penetration of the pile 1 into the pile interior 4. This is made possible by means of the beveled pile tip 6 relative to an (imaginary) horizontal line.

A pressure probe 12 is further arranged on the outer wall 5 of the pile 1. It is understood that, in addition to the illustrated pressure probes 12, more or less of such pressure probes 12 may be arranged on the outer wall 5 of the pile. The pressure probes 12 are suitable for detecting pressures and/or friction, such as modified CPTs, which are fixedly connected (or connected with defined stiffness) to the pile 1 to be installed. Furthermore, the pressure probes 12 are connected to means for detecting the rate of penetration, so that the means for detecting the rate of penetration can, for example, evaluate measurement data from the pressure probes 12.

Alternatively, the pressure probe 12 itself may comprise or represent the means for detecting the rate of penetration. In the event that, for example, the sensed pressure increases, it may be assumed that the rate of penetration of the pile 1 into the seabed decreases. The means for detecting the rate of penetration 11 may further send one or more control signals, for example to the pump 10 or the compressor 9, so that, for example, air with increased air pressure is applied via the one or more air lances 3, for example in the pile interior 4, or alternatively or additionally, to the outer wall 5 of the pile 1. In the latter case, it is understood that the one or more air lances 3 must then be able to apply air to the outer wall 5 of the pile 1. For example, one or more air lances 3 can be arranged on the support frame 8 in such a way that they run externally on the pile 1. However, this is not illustrated in FIG. 2.

In the event that the means for detecting the rate of penetration 11 send a control signal to the pump 10, for example, fluid may be pumped from within the pile 4. In the event that the liquid or water level inside the pile 1 is lower than the water level W, the effective mass of the pile 1 increases so that the rate of penetration (penetration velocity) of the pile 1 into the seabed MB is increased.

Air lances are removable after installation of the pile by, for example, removing the support frame on which the one or more air lances are located.

The embodiments of the present invention described in this specification and the optional features and characteristics indicated in a respective case with respect thereto are also intended to be understood as disclosed in all combinations with each other. In particular, the description of a feature encompassed by an embodiment example—unless explicitly stated to the contrary—is also not to be understood herein as meaning that the feature is indispensable or essential for the function of the embodiment example. The sequence of the method steps described in this specification in the individual flowcharts is not mandatory; alternative sequences of the method steps are conceivable. The method steps can be implemented in various ways, for example, implementation in software (by program instructions), hardware or a combination of both is conceivable for implementing the method steps.

Terms used in the patent claims such as "comprise", "have", "include", "contain" and the like do not exclude further elements or steps. The phrase "at least in part" includes both the case "in part" and the case "in full". The phrase "and/or" is intended to be understood to disclose both the alternative and the combination, thus "A and/or B" means "(A) or (B) or (A and B)". The use of the indefinite article does not preclude a plural. A single apparatus may perform the functions of multiple units or devices recited in the claims. Reference signs indicated in the patent claims are not to be considered as limitations of the means and steps employed.

LIST OF REFERENCE SIGNS

1 Pile
2 Liquefaction zone
3 Air and/or gas lance
4 Interior of the pile
5 External wall of the pile
6 End of the pile penetrating into the building ground
7 Air and/or gas bubbles
8 Support frame
9 Compressor
10 Pump
11 Means for detecting the rate of penetration
12 Pressure probe
MB Seabed
W Water level
V Movability of the support frame

The invention claimed is:

1. A method for vibrating-in a foundation into a building ground by initiating vibrations generated by means of a vibrating device attached to the foundation, the vibrations causing liquefaction of the building ground so that the foundation penetrates the building ground, wherein the rate of penetration of the foundation into the building ground is controlled and/or regulated by varying a liquefaction zone of the building ground directly surrounding the foundation, wherein the rate of penetration is varied by varying the size of the liquefaction zone, wherein means for detecting the rate of penetration are provided, which detect whether the penetration advancement of the foundation is slowed down by increasing an effective mass of the foundation and/or enlarging the liquefaction zone, wherein the penetration progress detection means detect one or more insertion parameters, wherein the effective mass of the foundation is increased and decreased during the penetration into the building ground by means of pumping liquid from the interior or into the interior of the foundation.

2. The method according to claim 1, wherein the liquefaction zone is varied by means of an injection of air and/or gases at the foundation.

3. The method according to claim 2, wherein the air and/or the gas is injected inside the foundation, and/or at the outer wall of the foundation.

4. The method according to claim 2, wherein the rate of penetration of the foundation into the building ground of the foundation is varied by a pump and/or a compressor generating air and/or gas pressure, wherein the pump and/or compressor are detachably connected to the foundation.

5. The method according to claim 4, wherein the means for varying the rate of penetration are comprised by a carrier device.

6. The method according to claim 2, wherein the air and/or the gas is applied above the end of the foundation penetrating into the building ground.

7. The method according to claim 6, wherein the air and/or the gas is further applied inside the foundation.

8. The method according to claim 2, wherein the air and/or gas is applied at an air pressure and/or gas pressure greater than the water and/or soil pressure prevailing at the end of the foundation penetrating the building ground.

9. The method according to claim 1, wherein the size of the liquefaction zone is varied by means of an injection of air and/or gases with increased or decreased air pressure and/or gas pressure at the foundation.

10. The method according to claim 1, wherein the penetration of the foundation into the building ground is not interrupted during the vibrating-in.

11. The method according to claim 1, wherein the penetration of the foundation into the building ground is accelerated, slowed down or interrupted during the vibrating-in.

12. An apparatus for vibrating-in a foundation into a building ground, comprising:

a vibrating device for generating vibrations; and means for varying a liquefaction zone which directly surrounds the building ground of the foundation and by which the rate of penetration of the foundation into the building ground is controllable and/or regulatable, wherein, means for detecting the rate of penetration for detecting whether the advancement of the vibrating-in of the foundation is slowed down by increasing an effective mass of the foundation and/or enlarging the liquefaction zone, wherein the penetration progress detection means detect one or more insertion parameters; and means for pumping liquid from the interior or into the interior of the foundation.

13. The apparatus according to claim 12, further comprising one or more of the following means:

means for injecting air and/or gases at the foundation;

at least one pressure probe for detecting pressures at the outer wall and/or inner side of the foundation and/or at the end of the foundation penetrating into the building ground; and means for detecting a friction between the outer wall of the foundation and the building ground.

14. The apparatus according to claim 12, wherein the foundation is a pile, and/or wherein the foundation is for an offshore structure, and/or wherein the building ground is the seabed.

* * * * *